United States Patent [19]

Osada et al.

[11] Patent Number: 4,457,780

[45] Date of Patent: Jul. 3, 1984

[54] ELECTRIC CONTACT MATERIALS

[75] Inventors: Mitsuo Osada; Nobuhito Kuroishi; Yoshinari Amano; Akira Fukui, all of Hyogo, Japan

[73] Assignee: Sumitomo Electric Industries, Ltd., Osaka, Japan

[21] Appl. No.: 367,603

[22] Filed: Apr. 12, 1982

[30] Foreign Application Priority Data

| | | | |
|---|---|---|---|
| Apr. 10, 1981 | [JP] | Japan | 56-54633 |
| Jul. 10, 1981 | [JP] | Japan | 56-108535 |
| Jul. 10, 1981 | [JP] | Japan | 56-108536 |
| Jul. 10, 1981 | [JP] | Japan | 56-108537 |
| Jul. 15, 1981 | [JP] | Japan | 56-110496 |
| Jul. 15, 1981 | [JP] | Japan | 56-110497 |
| Jul. 31, 1981 | [JP] | Japan | 56-121274 |
| Nov. 13, 1981 | [JP] | Japan | 56-181923 |
| Nov. 13, 1981 | [JP] | Japan | 56-181929 |
| Nov. 13, 1981 | [JP] | Japan | 56-181930 |
| Nov. 13, 1981 | [JP] | Japan | 56-181931 |
| Nov. 13, 1981 | [JP] | Japan | 56-181932 |

[51] Int. Cl.[3] ..... B22F 3/00

[52] U.S. Cl. ..... 75/236; 75/237; 75/238; 200/205; 200/206; 419/21; 419/10

[58] Field of Search ..... 75/236, 237, 238; 200/205, 206; 419/21, 10

[56] References Cited

U.S. PATENT DOCUMENTS

| | | | |
|---|---|---|---|
| 2,180,956 | 11/1939 | Hensel | 419/12 |
| 2,234,969 | 3/1941 | Hensel et al. | 200/266 |
| 2,319,240 | 5/1943 | Larsen et al. | 200/265 |

FOREIGN PATENT DOCUMENTS

| | | | |
|---|---|---|---|
| 51-95271 | 2/1976 | Japan | 200/266 |

OTHER PUBLICATIONS

Jones, W. D., *Fundamental Principles of Powder Metallurgy,* 1960, pp. 766–773.

*Primary Examiner*—Brooks H. Hunt

*Attorney, Agent, or Firm*—Wenderoth, Lind & Ponack

[57] ABSTRACT

The invention relates to electric contact materials for use in switches, such as moulded circuit breakers, air circuit breakers, magnetic switches, etc.

The electric contact materials comprise 5–60 weight % iron group metals, 1–11 weight % graphite, 5–70 weight % refractory materials, and the residual part consisting of silver, said refractory materials being held in the state of dispersion in the iron group metals and/or silver, thereby providing welding resistance, wear resistance, and insulation resistance as well as high practical utility of low temperature rise.

8 Claims, 4 Drawing Figures

ELECTRIC CONTACT MATERIALS

The invention relates to electric contact materials for use in switches, and particularly to improvement in the properties of Ag-carbide alloys, Ag-nitride alloys, Ag-boride alloys and Ag-silicide alloys for contact materials (hereinafter referred to as alloys). In particular, Ag-WC alloys among Ag-carbide alloys have been in extensive use as contacts of moulded circuit breakers and magnetic switches for their high resistance to arc and welding.

Recently, however, there is a marked tendency toward miniaturization and improvement on performance of the switches comprising moulded circuit breakers and magnetic switches including no-fuse breakers. Since the contact materials are subjected to greater load, improved performance has come to be strongly demanded. Due to miniaturization of the switches, the contact dimensions and the contact pressure have come to be reduced. Thus the wear and scattering of the contacts at each break of the circuit result in various difficulties, such as welding of the contacts, deteriorated insulation of the switches, inevitable temperature rise at each switching of the rated current, etc. These difficulties may be obviated, for example, by a contact obtained by adding graphite (Gr) to Ag-WC alloy. In this contact, Gr is converted to reducing gas by the arc heat produced at the time of switching and prevents oxidization of WC, while the lubricating effect of Gr helps reduce the temperature rise and increase the welding resistance.

However, this contact has a disadvantage in that the wear and insulation resistance is adversely reduced by the addition of Gr. Thus, in small-sized high-performance breakers and switches, it was unavoidable that Ag-WC contacts were combined with Ag-WC-Gr contacts, the former for the movable contacts and the latter for the stationary contacts. However, it was particularly inefficient in respect of preparation of the parts to have to change the materials for the movable contacts and stationary contacts, respectively. Even in such combination, the contact pressure is insufficient in the recent small-sized high performance switches, the arc heat developed at each switching frequently causing abnormal temperature rise, greater wear, deteriorated insulation and heavy welding. Thus further improvements on the performance of the contacts are now strongly demanded.

A second alternative is an Ag-Ni-nitride contact. Though this contact has good wear resistance, its contact resistance is high and its weld resistance is unsatisfactory. Thus its range of use is limited.

A third alternative is an Ag-Ni-boride contact. However, the range of use of this contact is also limited since it has a disadvantage in respect of temperature rise.

In view of the difficulties described hereinabove, the invention has for an object to provide contact alloys having high properties of welding resistance, wear resistance and insulation resistance coupled with high practical use in respect of low temperature rise. The invention provides economical contact alloys usable even when the amount of costly silver is reduced to a considerable degree.

The invention will hereinunder be described in detail in reference to the accompanying drawings.

FIGS. 2 and 3 are microphotographs of 1,000 magnifications of alloys for obtaining the electric contact materials according to the invention, A1-4 of Example 1 and A2-2 of Example 2, respectively.

FIG. 4 is a microanalytic photograph of 1,000 magnifications of one of the alloys according to the invention.

Figure 1:
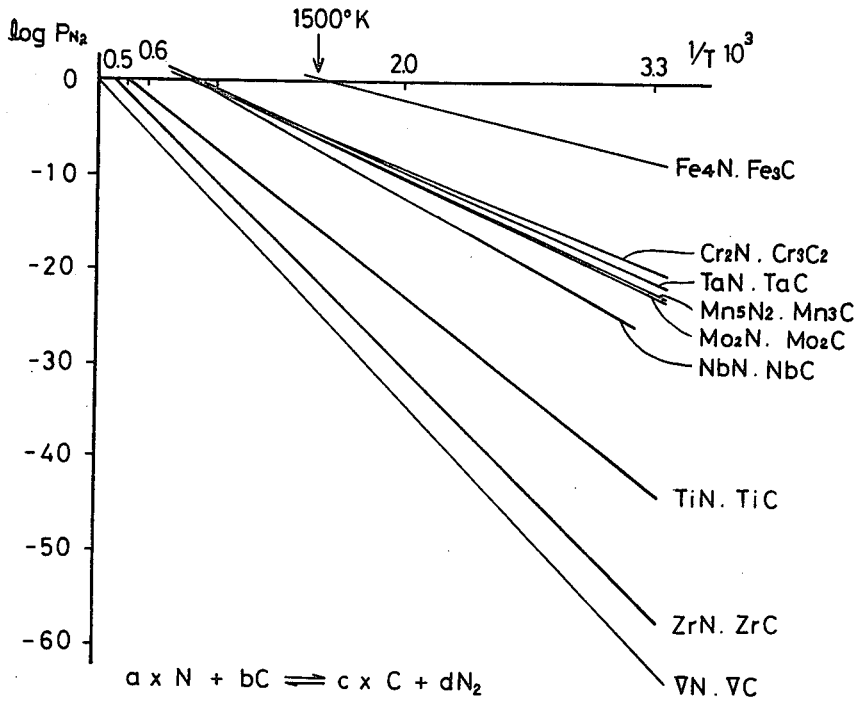
FIG. 1 is a chart showing the reaction energy between metallic carbides and metallic nitrides.

The alloys according to the invention are for use in electric contact materials characterized in that said alloys comprise iron group metals and silver containing, dispersed therein, a group IVa, Va or VIa refractory metal at least one member selected from among carbides, nitrides, borides and silicides thereof, or nitrides of group IVa,Va,VIa, VIIa, and VIIIa metals, and graphite, part or all of said metals, carbides, nitrides, borides and silicides being dispersed in the iron group metals and silver.

The characteristics of the alloys according to the invention will now be described in detail.

At first, the inventors made a series of tests on alloys comprising silver with iron group metals, groups IVa,-Va,VIa refractory metals and carbides, nitrides, borides and silicides of said metals added thereto. As a result, the inventors found that the alloys in which part of all of the refractory materials was dispersed in said iron group metals were capable of minimizing the wear and consumption due to arc heat developed at each circuit switching with the effect of reducing the deterioration of insulation and welding of the switches.

In particular, in a test conducted on Ag-Ni-nitride alloy it was found that in case of a sintered compact below the melting point of silver, particles of nickel and nitride thereof alone were present independently and the wear under a heavy electric current was relatively inferior compared with the case of Ag-CdO alloy in respect of performance as a contact. However, when sintered at a temperature above the melting point of silver, alloy in which part or all of the nitride was solidly dissolved in nickel was obtainable. It was found that the sintered compact thus obtained had the same effect as described hereinabove. It is known in the fields of cemented carbide, heat resisting alloys, etc. that iron group metals with refractory materials dispersed therein have great strength and bindability at high temperatures. The inventors, however, have found that alloys obtained by combining Ag with Gr exhibit particularly improved performance as contacts.

It has further been found that, though generally the mutual reaction between iron group metals and refractory materials (groups IVa,Va,VIa metals, carbides, nitrides, borides and silicides thereof) arises exclusively at high temperatures, in the presence of Ag, the reaction is expedited through said Ag which is turned into liquid phase in the course of sintering.

However, the iron group metals and refractory materials have a disadvantage in that they are oxidized by arc heat developed at each switching due to their poor resistance to oxidization, thereby increasing the contact resistance and urging the temperature rise of the switches.

If Gr having a high reducibility is added as antioxidant of the iron group metals and refractory materials to said contact alloy, Gr is decomposed by the heat developed at each switching to produce a reducing gas thereby preventing the iron group metals and refractory materials from oxidization, decreasing the contact resistance, reducing the temperature rise of the switches, and increasing the welding resistance by means of the lubricity of Gr.

It has also been found that, when Gr is added, the properties of arc wear resistance are greatly improved by the endothermic reaction caused by the formation of carbides through the reaction between the nitrides and dispersed Gr due to arc heat developed at each switching as well as arc extinguishing effect by the release of $N_2$ gas. FIG. 1 shows the variation of free energy of said reaction, demonstrating that said reaction proceeds usually at 1500° K.

Thus, contact materials having greater resistance to temperature rise and welding are obtainable by producing skeletal structures in which refractory materials are dispersed in silver or iron group metals having high mechanical strength and bonding strength thereby enabling an increase in the resistance to wear and welding, Gr having high reducibility and lubricity being further added and dispersed. Thus the inventors succeeded in obtaining alloys having greater resistance to welding, wear, insulation and temperature rise than could hitherto be expected from the conventional Ag-WC, AG-WC-Gr, Ag-Ni-nitride or Ag-Ni-boride contact alloys.

The inventors have further found that, if nitrides of groups IVa,Va,VIa,VIIa,VIIIa metals are added, said nitrides react with carbides through iron group metals in the course of sintering at a temperature above the melting point of silver, thus the carbides being dispersed into fine particles thereby enabling to minimize deformation at high temperatures.

The iron group metals according to the invention comprise Fe,Co,Ni and the like, the amount of said metals being 5–60 weight %, preferably 20–50 weight %. If below 5 weight %, not only the skeletal structure is not formed due to dispersion of the iron group metals in silver, but also the wear resistance is not improved due to small dispersion of the refractory materials into the iron group metals. If in excess of 60 weight %, the conact resistance is not reduced even when Gr is added. Thus the effect of improvement of the temperature rise is not obtainable.

The effective refractory materials comprise groups IVa, Va,VIa metals, e.g., W,Mo,Ta,Nb,Ti,Cr,V,Zr,etc., carbides, nitrides, borides, and silicides thereof, etc., the amount of said materials being 5–70 weight %, and particularly preferably 20–50 weight %. If the amount of the refractory materials is below 5 weight %, the resistance to welding and wear is insufficient since the amount of said refractory materials in Ag and the iron group metals is too small. If an excess of 70 weight %, the contact resistance is not reduced even when Gr is added, no improvement of the temperature rise being observable.

If the refractory materials comprise nitrides of groups IVa,Va,VIa,VIIa,VIIIa metals, such as Ti,Zr,Nb,Cr-,Mo,Mn,Fe, V,Ta,etc., the amount of use thereof is preferably 5–50 weight %, and particularly preferably 10–25 weight %.

If the nitrides are less than 5 weight %, the wear resistance is insufficient since the amount of the nitrides in silver is too small. If in excess of 50 weight %, the contact resistance is not reduced even when Gr is added. Thus no improvement of the temperature rise is observable.

In case of using one member selected from among the nitrides of groups IVa to VIIIa metals together with carbides of groups IVa,Va,VIa refractory metals, the amount of said nitrides for obtaining good results is preferably 0.1–30 weight %, and particularly preferably 0.5–20 weight %, relative to 5–70 weight % carbides. If below 0.1 weight %, the effect of wear resistance is small, while if in excess of 30 weight %, the contact resistance is increased even when Gr is added, the temperature rise being reduced.

The refractory material may also comprise a boride and a silicide of a group IVa, Va, VIa refractory metal wherein the amount of the silicide is 0.1–30 weight %; or may also comprise a group IVa, Va, VIa refractory metal and a nitride thereof wherein the amount of the refractory metal is 0.1–30 weight %.

When 5–70 weight % said carbides and group IVa,-Va,VIa metals are used, the amount of the metals is preferably 0.1–5 weight %, and particularly preferably 0.5–2 weight %. If below 0.1 weight %, the amount of reaction with Gr is small and the effect of improvement of the wear resistance is insufficient. If in excess of 5 weight %, metals remaining unreacted with Gr are oxidized in the course of switching thereby increasing the contact resistance while reducing the temperature rise.

The effective range of Gr is 1–11 weight %, and preferably 3–7 weight %. If below 1 weight %, temperature rise is observable even when the iron group metals and refractory materials are within their range. If in excess of 11 weight %, not only the alloys have little practical utility due to brittleness and poor wear resistance, but also the very production thereof is accompanied by difficulties.

Mixture of metallic elements, such as Al,Si,Se,Te,Bi, Zn,Cd,In,Sn,Ca,Na,etc. is permissible if in the amount below 0.1 weight % which is not detrimental to the object of the invention.

According to the invention, the alloys for use in electric contact materials are obtainable as follows. Powders of the aforedescribed materials are blended, mixed and then pressed, the green compacts thus obtained being sintered at a temperature higher than the melting point of Ag, i.e., above 1000° C., in an atmosphere of a reducing gas, such as $H_2$, CO or ammonia cracked gas, for 1–5 hours.

The invention will hereinunder be described in more detail in reference to the following examples.

EXAMPLE 1

Powders blended in the ratio shown in Tables 1-1,1-2,1-3 and 1-4 were mixed and pressed. The green compacts thus produced were sintered in hydrogen atmosphere at 1100° C. for 2 hours. The sintered compacts thus obtained were re-pressed to produce alloys having a porosity of almost zero. The alloys of Table 1-4 were conventional alloys used as reference materials.

TABLE 1-1 unit: weight %

| Alloy Symbol | Ag | Ni | WC | Gr |
|---|---|---|---|---|
| A 1-1 | 89 | 5 | 5 | 1 |
| A 1-2 | 77 | 10 | 10 | 3 |
| A 1-3 | 55 | 10 | 30 | 5 |
| A 1-4 | 10 | 10 | 70 | 10 |
| A 1-5 | 67 | 20 | 10 | 3 |
| A 1-6 | 55 | 20 | 20 | 5 |
| A 1-7 | 43 | 20 | 30 | 7 |
| A 1-8 | 33 | 30 | 30 | 7 |
| A 1-9 | 10 | 40 | 40 | 10 |
| A 1-10 | 10 | 60 | 20 | 10 |

TABLE 1-2

| Alloy Symbol | Ag | Ni | MoC | TiC | TaC | $Cr_3C_2$ | Gr |
|---|---|---|---|---|---|---|---|
| | unit: weight % | | | | | | |
| B 1-1 | 65 | 20 | 10 | — | — | — | 5 |
| B 1-2 | 55 | 20 | 20 | — | — | — | 5 |
| B 1-3 | 55 | 20 | — | 20 | — | — | 5 |
| B 1-4 | 52 | 20 | — | — | 20 | 3 | 5 |
| B 1-5 | 55 | 20 | — | — | — | 20 | 5 |

TABLE 1-3

| Alloy Symbol | Ag | Fe | Co | WC | Gr |
|---|---|---|---|---|---|
| | unit: weight % | | | | |
| C 1-1 | 53 | 10 | — | 30 | 7 |
| C 1-2 | 53 | — | 10 | 30 | 7 |
| C 1-3 | 43 | — | 20 | 30 | 7 |

TABLE 1-4

| Alloy Symbol | Ag | WC | Gr |
|---|---|---|---|
| | unit: weight % | | |
| D 1-1 | 60 | 40 | — |
| D 1-2 | 60 | 35 | 5 |
| D 1-3 | 50 | 50 | — |
| D 1-4 | 95 | — | 5 |

Figure 2:
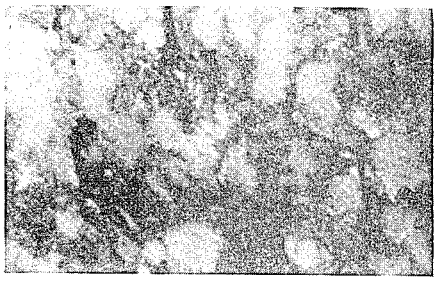
Figure 2:
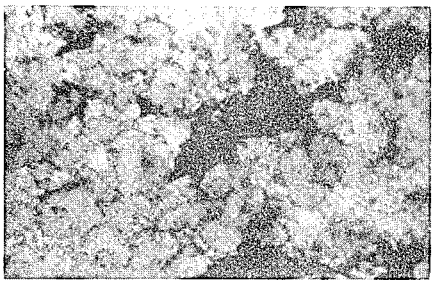
Figure 2:
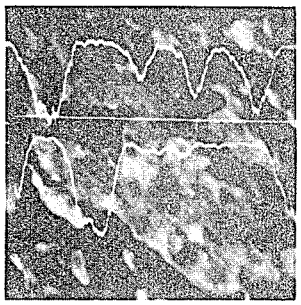

FIG. 2 is a microphotograph of 1,000 magnifications showing the microstructure of one of the alloys according to the invention (A1-4). In the microphotograph, the white part represents the silver phase, the light grey part represents the Ni phase, the dark grey particles in the Ni phase represents the WC phase, and the dark and irregularly shaped part represents the graphite phase. As the photograph shows, the alloy according to the invention consists of a microstructure in which carbides are solidly dissolved in iron group metals in reaction with the latter in the course of sintering, the carbides being dispersed in Ag phase. Conceivably, the alloy according to the invention exhibits properties of high heat resistance and small arc wear for the reason that the skeletal structure is composed of said hard phase.

The alloys produced by the aforedescribed process were subjected to an ASTM testing device to evaluate the conductivity and wear resistance. The conditions were: AC 100V, 50A, pfl.0, contact pressure 200 gr, opening force 200 gr, contact size 5×5×1.5 mm, switching 20,000 operations. The voltage scattering range and wear amount after 20,000 operations are shown in Table 1-5.

TABLE 1-5

| Alloy Symbol | Wear Amount (mg) | Range of Voltage Drop (mv) | Scattering of Voltage Drop (mv) |
|---|---|---|---|
| A 1-1 | 13 | 10~55 | 45 |
| A 1-2 | 10 | 12~68 | 56 |
| A 1-3 | 4 | 18~81 | 63 |
| A 1-4 | 12 | 34~151 | 117 |
| A 1-5 | 2 | 17~81 | 64 |
| A 1-6 | 2 | 17~71 | 54 |
| A 1-7 | 3 | 19~91 | 72 |
| A 1-8 | 8 | 23~111 | 88 |
| A 1-9 | 12 | 34~148 | 114 |
| A 1-10 | 12 | 31~121 | 90 |
| B 1-1 | 10 | 21~93 | 72 |
| B 1-2 | 14 | 30~99 | 69 |
| B 1-3 | 21 | 17~83 | 66 |
| B 1-4 | 31 | 25~116 | 91 |
| B 1-5 | 28 | 17~79 | 62 |
| C 1-1 | 16 | 31~113 | 82 |
| C 1-2 | 15 | 33~101 | 68 |
| C 1-3 | 23 | 39~159 | 120 |
| D 1-1 | 68 | 17~363 | 346 |
| D 1-2 | 81 | 17~271 | 254 |
| D 1-3 | 57 | 23~900 | 877 |
| D 1-4 | 281 | 10~183 | 173 |

The alloys A1-6, B1-2, C1-2 and the reference alloys, D1-1, D1-2, D1-3, D1-4, were machine into movable contacts of 4×7×2 mm and stationary contacts of 8×8×2 mm, respectively. The contacts thus produced were bonded to alloys by resistance welding and mounted on breakers for 50A rated current. The contact performance was evaluated under the following conditions to obtain the results of Table 1-6.

Overhead Test: AC220V, 200A pf, 50 times
Endurance Test: AC 220V, 50A pf, 5000 times
Temperature Rise Test: AC220V, 50A, 2H
Short Circuit Test: AC220V, 7.5KA, pf 0.5 1P O—CO, 2P O—CO

TABLE 1-6

| Alloy Symbol | Over load Test | Endurance Test | Temperature rise Test (°C.) | Short Circuit Test | Wear Amount (mg) | Insulation Resistance (MΩ) |
|---|---|---|---|---|---|---|
| A1-6 | OK | OK | 15 | OK | 51 | ∞ |
| B1-2 | " | " | 21 | " | 83 | " |
| C1-2 | " | " | 25 | " | 111 | " |
| D1-1 | " | " | 103 | " | 258 | 1000 |
| D1-2 | " | " | 43 | " | 412 | 100 |
| D1-3 | " | " | 131 | " | 201 | 1000 |
| D1-4 | Test discontinued due to heavy wear of contact | | | | | |

As Table 1-6 shows, the alloys according to the invention have contact properties of high performance, e.g., small wear amount, low temperature rise and high insulation resistance.

EXAMPLE 2

Powders blended in the ratio of Tables 2-1, 2-2, 2-3 and 2-4 were mixed and pressed. The green compacts thus produced were sintered in hydrogen atmosphere at 1150° C. for 2 hours. The sintered compacts thus obtained were re-pressed to produce alloys having a porosity of almost zero. The alloys of Table 2-4 were conventional alloys used as reference materials.

TABLE 2-1

| Alloy Symbol | Ag | Ni | TiN | Gr |
|---|---|---|---|---|
| | unit: weight % | | | |
| A 2-1 | 70 | 20 | 5 | 5 |
| A 2-2 | 60 | 20 | 15 | 5 |

TABLE 2-1-continued unit: weight %

| Alloy Symbol | Ag | Ni | TiN | Gr |
|---|---|---|---|---|
| A 2-3 | 45 | 20 | 30 | 5 |
| A 2-4 | 25 | 20 | 50 | 5 |
| A 2-5 | 75 | 5 | 15 | 5 |
| A 2-6 | 50 | 30 | 15 | 5 |
| A 2-7 | 20 | 60 | 15 | 5 |
| A 2-8 | 53 | 30 | 15 | 2 |
| A 2-9 | 48 | 30 | 15 | 7 |
| A 2-10 | 45 | 30 | 15 | 10 |

TABLE 2-2 unit: weight %

| Alloy Symbol | Ag | Ni | ZrN | $Cr_2N$ | $Mo_2N$ | $Mn_5N_2$ | Gr |
|---|---|---|---|---|---|---|---|
| B 1 | 65 | 20 | 10 | — | — | — | 5 |
| B 2 | 55 | 20 | 20 | — | — | — | 5 |
| B 3 | 55 | 20 | — | 20 | — | — | 5 |
| B 4 | 52 | 20 | — | — | 20 | 3 | 5 |
| B 5 | 55 | 20 | — | — | — | 20 | 5 |

TABLE 2-3 unit: weight %

| Alloy Symbol | Ag | Fe | Co | TiN | Gr |
|---|---|---|---|---|---|
| C 2-1 | 55 | 10 | — | 30 | 5 |
| C 2-2 | 55 | — | 10 | 30 | 5 |
| C 2-3 | 45 | — | 20 | 30 | 5 |

TABLE 2-4 unit: weight %

| Alloy Symbol | Ag | Ni | TiN | Gr |
|---|---|---|---|---|
| D 2-1 | 65 | 20 | 15 | — |
| D 2-2 | 75 | 20 | — | 5 |

FIG. 3 is a microphotograph of 1,000 magnifications showing the microstructure of the alloy (A2-2) according to the invention. In the microphotograph, the white part represents silver phase, pale grey part representing nickel phase, the dark grey particles around the nickel phase representing TiN phase, the irregular black part representing graphite phase. The microphotograph shows that the alloys according to the invention consist of a skeletal structure in which nitrides react with iron group metals in the course of sintering, said nitrides being solidly dissolved and educed. It is conceivable that the alloys according to the invention exhibit physical properties of high heat resistance and low arc erosion resistance since the skeletal structure consists of the aforedescribed hard phase.

The alloys thus produced were subjected to an ASTM testing device under the same conditions as in Example 1 to evaluate the dielectric properties and wear properties. The results were as shown in Table 2-5.

TABLE 2-5

| Alloy Symbol | Wear Amount (mg) | Range of Voltage Drop (mv) | Scattering of Voltage Drop (mv) |
|---|---|---|---|
| A 2-1 | 15 | 8~68 | 60 |
| A 2-2 | 2 | 11~81 | 70 |
| A 2-3 | 18 | 18~91 | 73 |
| A 2-4 | 20 | 58~321 | 263 |
| A 2-5 | 16 | 11~80 | 69 |
| A 2-6 | 3 | 13~85 | 72 |
| A 2-7 | 8 | 20~110 | 90 |
| A 2-8 | 8 | 23~111 | 88 |
| A 2-9 | 8 | 10~85 | 75 |
| A 2-10 | 40 | 21~93 | 72 |
| B 2-1 | 14 | 31~131 | 100 |
| B 2-2 | 16 | 19~99 | 80 |
| B 2-3 | 23 | 17~83 | 66 |
| B 2-4 | 21 | 18~116 | 98 |
| B 2-5 | 31 | 19~77 | 58 |
| C 2-1 | 16 | 31~321 | 290 |
| C 2-2 | 13 | 33~101 | 68 |
| C 2-3 | 22 | 39~159 | 120 |
| D 2-1 | 38 | 23~555 | 532 |
| D 2-2 | 157 | 10~101 | 91 |

In connection with A2-2 and D2-1 of Table 2-5, the phases formed on the surfaces of the contacts before and after the ASTM test were analysed by X-ray diffraction to obtain the results as shown in Table 2-6.

By the addition of Gr of Ag-Ni-TiN, the formation of NiO and $TiO_2$ was minimized. Conceivably, this was the reason why the voltage drop lowered.

TABLE 2-6

| Alloy Symbol | Before the Test | After the Test |
|---|---|---|
| A 2-2 | Ag, Ni, TiN, C | Ag, Ni, TiC, TiN, C |
| D 2-1 | Ag, Ni, TiN | Ag, NiO, TiO, TiN |

In connection with A2-2, B2-2, C2-2 and reference materials D2-1, D2-2, the contact properties were evaluated under the same conditions as in Example 1 to obtain the results as shown in Table 2-7.

TABLE 2-7

| Alloy Symbol | Overload Test | Endurance Test | Temperature rise Test (°C.) | Short Circuit Test | Wear Amount (mg) | Insulation Resistance(MΩ) |
|---|---|---|---|---|---|---|
| A2-2 | OK | OK | 28 | OK | 32 | ∞ |
| B2-2 | " | " | 32 | " | 41 | " |
| C2-2 | " | " | 25 | " | 61 | " |
| D2-1 | " | " | 103 | " | 83 | 1000 |
| D2-2 | Test discontinued due to heavy wear of contact | | | | | |

Table 2-7 shows that the alloys according to the invention have contact properties of improved performance, e.g., small wear amount, low temperature rise and high insulation resistance.

EXAMPLE 3

Powders blended in the ratio of Tables 3-1, 3-2, 3-3 and 3-4were mixed and pressed. Green compacts thus produced were sintered in hydrogen atmosphere at 1100° C. for 2 hours. The sintered compacts thus obtained were re-pressed to produce alloys having a porosity of almost zero. The alloys of Table 3-4 were conventional alloys used as reference materials.

TABLE 3-1 unit: weight %

| Alloy Symbol | Ag | Ni | WB | Gr |
|---|---|---|---|---|
| A 3-1 | 89 | 5 | 5 | 1 |
| A 3-2 | 77 | 10 | 10 | 3 |
| A 3-3 | 55 | 10 | 30 | 5 |
| A 3-4 | 10 | 10 | 70 | 10 |
| A 3-5 | 67 | 20 | 10 | 3 |
| A 3-6 | 55 | 20 | 20 | 5 |
| A 3-7 | 43 | 20 | 30 | 7 |
| A 3-8 | 33 | 30 | 30 | 7 |
| A 3-9 | 10 | 40 | 40 | 10 |
| A 3-10 | 10 | 60 | 20 | 10 |

TABLE 3-2 unit: weight %

| Alloy Symbol | Ag | Ni | $MoB_5$ | $TiB_2$ | $TaB_2$ | $CrB_2$ | Gr |
|---|---|---|---|---|---|---|---|
| B 3-1 | 65 | 20 | 10 | — | — | — | 5 |
| B 3-2 | 55 | 20 | 20 | — | — | — | 5 |
| B 3-3 | 55 | 20 | — | 20 | — | — | 5 |
| B 3-4 | 52 | 20 | — | — | 20 | 3 | 5 |
| B 3-5 | 55 | 20 | — | — | — | 20 | 5 |

TABLE 3-3 unit: weight %

| Alloy Symbol | Ag | Fe | Co | WB | Gr |
|---|---|---|---|---|---|
| C 3-1 | 53 | 10 | — | 30 | 7 |
| C 3-2 | 53 | — | 10 | 30 | 7 |
| C 3-3 | 43 | — | 20 | 30 | 7 |

TABLE 3-4 unit: weight %

| Alloy Symbol | Ag | $TiB_2$ | Ni |
|---|---|---|---|
| D 3-1 | 60 | 20 | 20 |

The alloys thus produced were subjected to an ASTM testing device under the same conditions as in Example 1 to evaluate the dielectric properties and wear properties thereof. The results were as shown in Table 3-5.

TABLE 3-5

| Alloy Symbol | Wear Amount (mg) | Range of Voltage Drop (mv) | Scattering of Voltage Drop (mv) |
|---|---|---|---|
| A 3-1 | 14 | 12~77 | 65 |
| A 3-2 | 9 | 14~90 | 76 |
| A 3-3 | 6 | 20~110 | 90 |
| A 3-4 | 10 | 40~190 | 150 |
| A 3-5 | 4 | 16~90 | 74 |
| A 3-6 | 4 | 16~89 | 73 |
| A 3-7 | 4 | 18~100 | 82 |
| A 3-8 | 7 | 25~141 | 116 |
| A 3-9 | 13 | 30~160 | 130 |
| A 3-10 | 10 | 33~145 | 112 |

TABLE 3-5-continued

| Alloy Symbol | Wear Amount (mg) | Range of Voltage Drop (mv) | Scattering of Voltage Drop (mv) |
|---|---|---|---|
| B 3-1 | 18 | 18~120 | 102 |
| B 3-2 | 16 | 28~120 | 92 |
| B 3-3 | 18 | 16~105 | 89 |
| B 3-4 | 30 | 30~140 | 110 |
| B 3-5 | 20 | 15~98 | 83 |
| C 3-1 | 17 | 30~136 | 106 |
| C 3-2 | 14 | 35~130 | 95 |
| C 3-3 | 25 | 40~168 | 128 |
| D 3-1 | 10 | 30~350 | 320 |

In connection with A 3-6, B3-2, C3-2 and the reference material D3-1, the contact properties were evaluated under the same conditions as in Example 1 to obtain the results as shown in Table 3-6.

TABLE 3-6

| Alloy Symbol | Overload Test | Endurance Test | Temperature rise Test (°C.) | Short Circuit Test | Wear Amount (mg) | Insulation Resistance (MΩ) |
|---|---|---|---|---|---|---|
| A 3-6 | OK | OK | 53 | OK | 60 | ∞ |
| B 3-2 | " | " | 61 | " | 75 | " |
| C 3-2 | " | " | 77 | " | 85 | " |
| D 3-1 | " | " | 135 | " | 102 | 500 |

As shown in Table 3-6, the alloys according to the invention have contact properties of high performance, e.g., small wear amount, low temperature rise and high insulation resistance.

EXAMPLE 4

Powders blended in the ratio of Tables 4-1, 4-2 and 4-3 were mixed and pressed. The green compacts thus produced were sintered in hydrogen atmosphere at 1100° C. for 2 hours. The sintered compacts thus obtained were re-pressed to produce alloys having a porosity of almost zero.

TABLE 4-1 unit: weight %

| Alloy Symbol | Ag | Ni | $WSi_2$ | Gr |
|---|---|---|---|---|
| A 4-1 | 89 | 5 | 5 | 1 |
| A 4-2 | 77 | 10 | 10 | 3 |
| A 4-3 | 55 | 10 | 30 | 5 |
| A 4-4 | 10 | 10 | 70 | 10 |
| A 4-5 | 67 | 20 | 10 | 3 |
| A 4-6 | 55 | 20 | 20 | 5 |
| A 4-7 | 43 | 20 | 30 | 7 |
| A 4-8 | 33 | 30 | 30 | 7 |
| A 4-9 | 10 | 40 | 40 | 10 |
| A 4-10 | 10 | 60 | 20 | 10 |

TABLE 4-2 unit: weight %

| Alloy Symbol | Ag | Ni | $Mo_3Si$ | TiSi | $Ta_2Si$ | $Cr_3Si$ | Gr |
|---|---|---|---|---|---|---|---|
| B 4-1 | 65 | 20 | 10 | — | — | — | 5 |
| B 4-2 | 55 | 20 | 20 | — | — | — | 5 |
| B 4-3 | 55 | 20 | — | 20 | — | — | 5 |
| B 4-4 | 52 | 20 | — | — | 20 | 3 | 5 |
| B 4-5 | 55 | 20 | — | — | — | 20 | 5 |

TABLE 4-3

| Alloy Symbol | Ag | Fe | Co | $WSi_2$ | Gr |
|---|---|---|---|---|---|
| | unit: weight % | | | | |
| C 4-1 | 53 | 10 | — | 30 | 7 |
| C 4-2 | 53 | — | 10 | 30 | 7 |
| C 4-3 | 43 | — | 20 | 30 | 7 |

The alloys thus produced were subjected to an ASTM testing device under the same conditions as in Example 1 to evaluate the dielectric properties and wear properties thereof. The results were as shown in Table 4-4.

TABLE 4-4

| Alloy Symbol | Wear Amount (mg) | Range of Voltage Drop (mv) | Scattering of Voltage Drop (mv) |
|---|---|---|---|
| A 4-1 | 18 | 20~85 | 65 |
| A 4-2 | 14 | 23~109 | 86 |
| A 4-3 | 9 | 27~110 | 83 |
| A 4-4 | 14 | 40~180 | 140 |
| A 4-5 | 7 | 25~112 | 87 |
| A 4-6 | 6 | 25~100 | 75 |
| A 4-7 | 9 | 29~122 | 93 |
| A 4-8 | 14 | 32~140 | 108 |
| A 4-9 | 14 | 43~179 | 136 |
| A 4-10 | 15 | 42~153 | 111 |
| B 4-1 | 21 | 30~125 | 95 |
| B 4-2 | 19 | 40~131 | 91 |
| B 4-3 | 26 | 29~115 | 86 |
| B 4-4 | 37 | 36~148 | 112 |
| B 4-5 | 29 | 27~109 | 82 |
| C 4-1 | 22 | 42~144 | 102 |
| C 4-2 | 20 | 43~132 | 89 |
| C 4-3 | 28 | 48~190 | 142 |

In connection with A4-6, B4-2 and C4-2, the contact properties were evaluated under the same conditions as in Example 1 to obtain the results as shown in Table 2-5.

TABLE 4-5

| Alloy Symbol | Overload Test | Endurance Test | Temperature rise Test (°C.) | Short Circuit Test | Wear Amount (mg) | Insulation Resistance(MΩ) |
|---|---|---|---|---|---|---|
| A 4-6 | OK | OK | 52 | OK | 62 | ∞ |
| B 4-2 | " | " | 71 | " | 93 | " |
| C 4-2 | " | " | 75 | " | 120 | " |

Table 4-5shows that the alloys according to the invention have contact properties of high performance, e.g., small wear amount, low temperature rise and high insulation resistance.

EXAMPLE 5

Powders blended in the ratio of Tables 5-1, 5-2 and 5-3 were mixed and pressed. The green compacts thus produced were sintered in hydrogen atmosphere at 1150° C. for 2 hours. The sintered compacts thus obtained were re-pressed to produce alloys having a porosity of almost zero.

TABLE 5-1

| Alloy Symbol | Ag | Ni | W | Gr |
|---|---|---|---|---|
| | unit: weight % | | | |
| A 5-1 | 89 | 5 | 5 | 1 |
| A 5-2 | 77 | 10 | 10 | 3 |

TABLE 5-1-continued

| Alloy Symbol | Ag | Ni | W | Gr |
|---|---|---|---|---|
| | unit: weight % | | | |
| A 5-3 | 55 | 10 | 30 | 5 |
| A 5-4 | 10 | 10 | 70 | 10 |
| A 5-5 | 67 | 20 | 10 | 3 |
| A 5-6 | 55 | 20 | 20 | 5 |
| A 5-7 | 43 | 20 | 30 | 7 |
| A 5-8 | 33 | 30 | 30 | 7 |
| A 5-9 | 10 | 40 | 40 | 10 |
| A 5-10 | 10 | 60 | 20 | 10 |

TABLE 5-2

| Alloy Symbol | Ag | Ni | Mo | Ti | Ta | Cr | Gr |
|---|---|---|---|---|---|---|---|
| | unit: weight % | | | | | | |
| B 5-1 | 65 | 20 | 10 | — | — | — | 5 |
| B 5-2 | 55 | 20 | 20 | — | — | — | 5 |
| B 5-3 | 55 | 20 | — | 20 | — | — | 5 |
| B 5-4 | 52 | 20 | — | — | 20 | 3 | 5 |
| B 5-5 | 55 | 20 | — | — | — | 20 | 5 |

TABLE 5-3

| Alloy Symbol | Ag | Fe | Co | W | Gr |
|---|---|---|---|---|---|
| | unit: weight % | | | | |
| C 5-1 | 53 | 10 | — | 30 | 7 |
| C 5-2 | 53 | — | 10 | 30 | 7 |
| C 5-3 | 43 | — | 20 | 30 | 7 |

The alloys were subjected to an ASTM testing device under the same conditions as in Example 1 to evaluate the dielectric properties and wear properties thereof. The results were as shown in Table 5-4.

TABLE 5-4

| Alloy Symbol | Wear Amount (mg) | Range of Voltage Drop (mv) | Scattering of Voltage Drop (mv) |
|---|---|---|---|
| A 5-1 | 12 | 15~60 | 45 |
| A 5-2 | 9 | 14~70 | 56 |
| A 5-3 | 5 | 20~90 | 70 |
| A 5-4 | 10 | 40~170 | 130 |
| A 5-5 | 1 | 20~88 | 68 |
| A 5-6 | 1 | 18~80 | 62 |
| A 5-7 | 4 | 21~100 | 79 |
| A 5-8 | 6 | 25~120 | 95 |
| A 5-9 | 10 | 36~150 | 114 |
| A 5-10 | 9 | 35~130 | 95 |
| B 5-1 | 14 | 23~100 | 77 |
| B 5-2 | 12 | 33~100 | 67 |
| B 5-3 | 19 | 19~90 | 71 |
| B 5-4 | 28 | 30~120 | 90 |
| B 5-5 | 21 | 19~81 | 62 |
| C 5-1 | 14 | 34~120 | 86 |
| C 5-2 | 12 | 35~110 | 75 |
| C 5-3 | 20 | 45~170 | 125 |

In relation to A5-6, B5-2 and C5-2, the contact performance was evaluated under the same conditions as in Example 1 to obtain the results as shown in Table 5-5.

TABLE 5-5

| Alloy Symbol | Overload Test | Endurance Test | Temperature rise Test (°C.) | Short Circuit Test | Wear Amount (mg) | Insulation Resistance (MΩ) |
|---|---|---|---|---|---|---|
| A 5-6 | OK | OK | 20 | OK | 45 | ∞ |
| B 5-2 | " | " | 25 | " | 74 | " |
| C 5-2 | " | " | 30 | " | 90 | " |

EXAMPLE 6

Powders blended in the ratio of Tables 6-1, 6-2 and 6-3 were mixed and pressed. The green compacts thus produced were sintered in hydrogen atmosphere at 1100° C. for 2 hours. The sintered compacts thus obtained were re-pressed to produce alloys having a porosity of almost zero.

TABLE 6-1 unit: weight %

| Alloy Symbol | Ag | Ni | WC | Gr | W | Mo | Ti | Cr |
|---|---|---|---|---|---|---|---|---|
| A 6-1 | 52 | 20 | 20 | 5 | 3 | — | — | — |
| A 6-2 | 53 | 20 | 20 | 5 | — | 2 | — | — |
| A 6-3 | 54 | 20 | 20 | 5 | — | — | 1 | — |
| A 6-4 | 54.5 | 20 | 20 | 5 | — | — | — | 0.5 |

TABLE 6-2 unit: Weight %

| Alloy Symbol | Ag | Ni | MoC | TiC | TaC | $Cr_3C_2$ | Gr | W | Cr |
|---|---|---|---|---|---|---|---|---|---|
| B 6-1 | 62 | 20 | 10 | — | — | — | 5 | 3 | — |
| B 6-2 | 54 | 20 | 20 | — | — | — | 5 | — | 1 |
| B 6-3 | 52.5 | 20 | — | 20 | — | — | 5 | 2 | 0.5 |

TABLE 6-3 unit: weight %

| Alloy Symbol | Ag | Fe | Co | WC | Gr | W | Cr |
|---|---|---|---|---|---|---|---|
| C 6-1 | 52 | 10 | — | 30 | 5 | 3 | — |
| C 6-2 | 54 | — | 10 | 30 | 5 | — | 1 |
| C 6-3 | 42.5 | — | 20 | 30 | 5 | 2 | 0.5 |

FIG. 4 is an X-ray microanalytic photograph of 1,000 magnifications of an alloy (A6-4) according to the invention. The center line is the measuring line, the line thereabove being the Gr chart line, the line therebelow being the Cr chart line. The photograph shows that the alloys according to the invention have high wear resistance and insulation resistance since Cr reacts with Gr particles in the course of sintering to form carbides on the surfaces of Gr particles thereby largely improving the moistening property of the Ag and Gr interface.

The alloys produced as described hereinabove were subjected to an ASTM testing device under the same conditions as in Example 1 to evaluate the dielectric properties and wear properties thereof. The results were as shown in Table 6-4.

TABLE 6-4

| Alloy Symbol | Wear Amount (mg) | Range of Voltage Drop (mv) | | Scattering of Voltage Drop (mv) |
|---|---|---|---|---|
| A 6-1 | 10 | 10 | 110 | 100 |
| A 6-2 | 7 | 11 | 98 | 87 |
| A 6-3 | 6 | 14 | 123 | 108 |
| A 6-4 | 1 | 10 | 50 | 40 |
| B 6-1 | 12 | 21 | 93 | 72 |
| B 6-2 | 14 | 30 | 99 | 69 |
| B 6-3 | 19 | 17 | 83 | 66 |
| C 6-1 | 14 | 31 | 113 | 82 |
| C 6-2 | 12 | 33 | 101 | 68 |
| C 6-3 | 22 | 39 | 159 | 120 |

In connection with A6-4, B6-3 and C6-3, the contact properties were evaluated under the same conditions as in Example 1 to obtain the results as shown in Table 6-5.

TABLE 6-5

| Alloy Symbol | Overload Test | Endurance Test | Temperature rise Test (°C.) | Short Circuit Test | Wear Amount (mg) | Insulation Resistance (MΩ) |
|---|---|---|---|---|---|---|
| A 6-4 | OK | OK | 21 | OK | 41 | ∞ |
| B 6-3 | " | " | 30 | " | 83 | " |
| C 6-3 | " | " | 25 | " | 72 | " |

As Table 6-5 shows, the alloys according to the invention have contact properties of high performance, e.g., small wear amount, low temperature rise and high insulation resistance.

EXAMPLE 7

Powders blended in the ratio of Tables 7-1, 7-2 and 7-3 were mixed and pressed. Green compacts thus produced were sintered in hydrogen atmosphere at 1100° C. for 2 hours. The sintered compacts thus obtained were re-pressed to produce alloys having a porosity of almost zero.

TABLE 7-1 unit: weight %

| Alloy Symbol | Ag | Ni | WC | Gr | TiN | ZrN | $Cr_2N$ | $Mo_2N$ |
|---|---|---|---|---|---|---|---|---|
| A 7-1 | 50 | 20 | 20 | 5 | 5 | — | — | — |
| A 7-2 | 50 | 20 | 20 | 5 | — | 5 | — | — |
| A 7-3 | 45 | 20 | 20 | 5 | — | — | 5 | 5 |
| A 7-4 | 35 | 20 | 20 | 5 | 20 | — | — | — |

TABLE 7-2 unit: weight %

| Alloy Symbol | Ag | Ni | MoC | TiC | TaC | $Cr_3C_2$ | Gr | TiN | $Mo_2N$ |
|---|---|---|---|---|---|---|---|---|---|
| B 7-1 | 60 | 20 | 10 | — | — | — | 5 | 5 | — |
| B 7-2 | 50 | 20 | 20 | — | — | — | 5 | — | 5 |
| B 7-3 | 50 | 20 | — | 20 | — | — | 5 | 3 | 2 |

TABLE 7-3 unit: weight %

| Alloy Symbol | Ag | Fe | Co | WC | Gr | TiN | $Mo_2N$ |
|---|---|---|---|---|---|---|---|
| C 7-1 | 48 | 10 | — | 30 | 7 | 5 | — |
| C 7-2 | 48 | — | 10 | 30 | 7 | — | 5 |
| C 7-3 | 36 | — | 20 | 30 | 7 | 2 | 5 |

The alloys were subjected to an ASTM testing device under the same conditions as in Example 1 to evaluate the dielectric properties thereof. The results were as shown in

TABLE 7-4

| Alloy Symbol | Wear Amount (mg) | Range of Voltage Drop (mv) | Scattering of Voltage Drop (mv) |
|---|---|---|---|
| A 7-1 | 2 | 10~55 | 45 |
| A 7-2 | 4 | 12~81 | 69 |
| A 7-3 | 5 | 12~61 | 49 |
| A 7-4 | 12 | 34~210 | 176 |
| B 7-1 | 21 | 30~99 | 69 |
| B 7-2 | 16 | 21~93 | 72 |
| B 7-3 | 14 | 17~83 | 66 |
| C 7-1 | 23 | 39~221 | 182 |
| C 7-2 | 16 | 31~121 | 90 |
| C 7-3 | 15 | 31~113 | 82 |

In connection with A7-1, B7-2 and C7-2, the contact performance was evaluated under the same conditions as in Example 2 to obtain the results as shown in Table 7-5.

TABLE 7-5

| Alloy Symbol | Overload Test | Endurance Test | Temperature rise Test (°C.) | Short Circuit Test | Wear Amount (mg) | Insulation Resistance (MΩ) |
|---|---|---|---|---|---|---|
| A 7-1 | OK | OK | 22 | OK | 41 | ∞ |
| B 7-2 | " | " | 28 | " | 81 | " |
| C 7-2 | " | " | 45 | " | 93 | " |

Table 7-5 shows that the alloys according to the invention have contact properties of high performance, e.g., small wear amount, low temperature rise and high insulation resistance.

EXAMPLE 8

Powders blended in the ratio of Tables 8-1, 8-2 and 8-3 were mixed and pressed. The green compacts thus produced were sintered in hydrogen atmosphere at 1100° C. for 2 hours. The sintered compacts thus obtained were re-pressed to produce alloys having a porosity of almost zero.

TABLE 8-1 unit: weight %

| Alloy Symbol | Ag | Ni | WC | Gr | TiN | ZrN | $Cr_2N$ | $Mo_2N$ | Cr |
|---|---|---|---|---|---|---|---|---|---|
| A 8-1 | 49.5 | 20 | 20 | 5 | 5 | — | — | — | 0.5 |
| A 8-2 | 49 | 20 | 20 | 5 | — | 5 | — | — | 1.0 |
| A 8-3 | 44 | 20 | 20 | 5 | — | — | 5 | 5 | 1.0 |

TABLE 8-1-continued unit: weight %

| Alloy Symbol | Ag | Ni | WC | Gr | TiN | ZrN | $Cr_2N$ | $Mo_2N$ | Cr |
|---|---|---|---|---|---|---|---|---|---|
| A 8-4 | 33 | 20 | 20 | 5 | 20 | — | — | — | 2.0 |

TABLE 8-2 unit: weight %

| Alloy Symbol | Ag | Ni | MoC | TiC | Gr | TiN | $Mo_2N$ | W | V | Ti |
|---|---|---|---|---|---|---|---|---|---|---|
| B 8-1 | 59 | 20 | 10 | — | 5 | 5 | — | 1 | — | — |
| B 8-2 | 49.5 | 20 | 20 | — | 5 | — | 5 | — | 0.5 | — |
| B 8-3 | 48 | 20 | — | 20 | 5 | 3 | 2 | — | — | 2.0 |

TABLE 8-3 unit: Weight %

| Alloy Symbol | Ag | Fe | Co | WC | Gr | TiN | $Mo_2N$ | Cr | Zr | Mo |
|---|---|---|---|---|---|---|---|---|---|---|
| C 8-1 | 47 | 10 | — | 30 | 7 | 5 | — | 1.0 | — | — |
| C 8-2 | 45 | — | 10 | 30 | 7 | — | 5 | — | 3 | — |
| C 8-3 | 33 | — | 20 | 30 | 7 | 2 | 5 | — | — | 3 |

The alloys were subjected to an ASTM testing device under the same conditions as in Example 1 to evaluate the dielectric properties and wear properties thereof. The results were as shown in Table 8-4.

TABLE 8-4

| Alloy Symbol | Wear Amount (mg) | Range of Voltage Drop (mv) | Scattering of Voltage Drop (mv) |
|---|---|---|---|
| A 8-1 | 1 | 12~58 | 46 |
| A 8-2 | 3 | 14~82 | 68 |
| A 8-3 | 4 | 16~72 | 56 |
| A 8-4 | 10 | 40~260 | 220 |
| B 8-1 | 20 | 35~105 | 70 |
| B 8-2 | 14 | 29~103 | 74 |
| B 8-3 | 12 | 19~99 | 80 |
| C 8-1 | 18 | 40~240 | 200 |
| C 8-2 | 14 | 35~133 | 98 |
| C 8-3 | 13 | 36~125 | 89 |

In connection with A8-1, B8-1 and C8-1, contact properties were evaluated under the same conditions as in Example 1 to obtain the results as shown in Table 8-5.

TABLE 8-5

| Alloy Symbol | Overload Test | Endurance Test | Temperature rise Test (°C.) | Short Circuit Test | Wear Amount (mg) | Insulation Resistance (MΩ) |
|---|---|---|---|---|---|---|
| A 8-1 | OK | OK | 25 | OK | 38 | ∞ |
| B 8-1 | " | " | 30 | " | 65 | " |
| C 8-1 | " | " | 50 | " | 86 | " |

EXAMPLE 9

Powders blended in the ratio of Tables 9-1, 9-2 and 9-3 were mixed and pressed. The green compacts thus produced were sintered in hydrogen atmosphere at 1100° C. for 2 hours. The sintered compacts thus obtained were re-pressed to produce alloys having a porosity of almost zero.

TABLE 9-1 unit: weight %

| Alloy Symbol | Ag | Ni | W | WC | TiN | WB | WSi | Gr |
|---|---|---|---|---|---|---|---|---|
| A 9-1 | 50 | 20 | 10 | — | 15 | — | — | 5 |
| A 9-2 | 50 | 20 | 15 | — | — | 10 | — | 5 |
| A 9-3 | 50 | 20 | 15 | — | — | — | 10 | 5 |
| A 9-4 | 50 | 20 | — | 15 | — | 10 | — | 5 |
| A 9-5 | 50 | 20 | — | 15 | — | — | 10 | 5 |
| A 9-6 | 50 | 20 | — | — | 10 | 15 | — | 5 |
| A 9-7 | 50 | 20 | — | — | 10 | — | 15 | 5 |
| A 9-9 | 50 | 20 | 5 | — | 10 | 10 | — | 5 |
| A 9-10 | 50 | 20 | 5 | — | 10 | — | 10 | 5 |
| A 9-11 | 50 | 20 | 5 | — | — | 10 | 10 | 5 |
| A 9-12 | 50 | 20 | 5 | 10 | — | 10 | — | 5 |
| A 9-13 | 50 | 20 | — | 10 | 10 | 5 | — | 5 |

TABLE 9-1-continued unit: weight %

| Alloy Symbol | Ag | Ni | W | WC | TiN | WB | WSi | Gr |
|---|---|---|---|---|---|---|---|---|
| A 9-14 | 50 | 20 | — | 10 | 10 | — | 5 | 5 |
| A 9-15 | 50 | 20 | — | 10 | — | 10 | 5 | 5 |
| A 9-16 | 50 | 20 | 5 | 10 | — | — | 10 | 5 |
| A 9-17 | 50 | 20 | — | — | 10 | 10 | 5 | 5 |
| A 9-18 | 50 | 20 | — | 10 | 5 | 5 | 5 | 5 |
| A 9-19 | 50 | 20 | 5 | 10 | 5 | 5 | — | 5 |
| A 9-20 | 50 | 20 | 5 | — | 10 | 5 | 5 | 5 |
| A 9-21 | 50 | 20 | 5 | 10 | 5 | — | 5 | 5 |
| A 9-22 | 50 | 20 | 5 | 10 | — | 5 | 5 | 5 |
| A 9-23 | 50 | 20 | 5 | 5 | 5 | 5 | 5 | 5 |

TABLE 9-2 unit: weight %

| Alloy Symbol | Ag | Ni | Co | Fe | Mo | MoC | TiC | $Mo_2N$ | ZrN | $TiB_2$ | $Mo_2B_5$ | $Mo_3Si$ | Gr |
|---|---|---|---|---|---|---|---|---|---|---|---|---|---|
| B 9-1 | 50 | 10 | 10 | | 10 | | | 15 | | | | | 5 |
| B 9-2 | 50 | 10 | | 10 | 10 | | | | 15 | | | | 5 |
| B 9-3 | 50 | 10 | 10 | 5 | 10 | | | | | 10 | | | 5 |
| B 9-4 | 50 | | 10 | 10 | 15 | | | | | | 10 | | 5 |
| B 9-5 | 50 | 10 | 10 | | 15 | | | | | | | 10 | 5 |
| B 9-6 | 50 | 10 | 10 | | | 15 | | | | 10 | | | 5 |
| B 9-7 | 50 | | 10 | 10 | | | 15 | | | | | 10 | 5 |
| B 9-8 | 50 | 10 | 10 | | | | | 15 | | | 10 | | 5 |
| B 9-9 | 50 | 10 | | 10 | | | | | 15 | | | 10 | 5 |
| B 9-10 | 50 | 10 | 10 | | | | | | | 15 | | 10 | 5 |
| B 9-11 | 50 | | 10 | 10 | 10 | | | 10 | | 5 | | | 5 |
| B 9-12 | 50 | 10 | 10 | | 10 | | | | 10 | | | 5 | 5 |
| B 9-13 | 50 | 10 | | 10 | 10 | | | | | | 10 | 5 | 5 |
| B 9-14 | 50 | 10 | 10 | | 10 | | 10 | | | 5 | | | 5 |
| B 9-15 | 50 | 10 | 10 | | | 10 | | 10 | | | 5 | | 5 |
| B 9-16 | 50 | 10 | | 10 | | | 10 | | 10 | | | 5 | 5 |
| B 9-17 | 50 | | 10 | 10 | | | 10 | | | 10 | | 5 | 5 |
| B 9-18 | 50 | 10 | 10 | | 5 | 10 | | | | | | 10 | 5 |
| B 9-19 | 50 | | 10 | 10 | | | | 15 | | 5 | | 5 | 5 |
| B 9-20 | 50 | 10 | | 10 | | 10 | | | 5 | 5 | | 5 | 5 |
| B 9-21 | 50 | 10 | 5 | | 10 | | 10 | 5 | | | 5 | | 5 |
| B 9-22 | 50 | 10 | | 5 | 15 | | | | 5 | 5 | | 5 | 5 |
| B 9-23 | 50 | 10 | 10 | | 10 | | 5 | 5 | | | | 5 | 5 |
| B 9-24 | 50 | 10 | | 10 | 5 | 10 | | | | | 5 | 5 | 5 |
| B 9-25 | 50 | 10 | 10 | | 5 | | 5 | | 5 | | 5 | 5 | 5 |

TABLE 9-3

| Alloy Symbol | Ag | Ni | W | Cr | TaC | $Cr_3C_2$ | WC | TiN | $Cr_2N$ | TiB | WB | TiSi | Gr |
|---|---|---|---|---|---|---|---|---|---|---|---|---|---|
| C 9-1 | 42 | 30 | 5 | | | | | 20 | | | | | 3 |
| C 9-2 | 50 | 35 | | 5 | | | | | | | 5 | | 5 |
| C 9-3 | 45 | 40 | 5 | | | | | | | | | 5 | 5 |
| C 9-4 | 53 | 20 | | | 15 | | | | | | 5 | | 7 |
| C 9-5 | 39 | 40 | | | | | | 15 | | | | 3 | 3 |
| C 9-6 | 53 | 25 | | | | | | 15 | | | 5 | | 2 |
| C 9-7 | 48 | 30 | | | | | | | 15 | | | 2 | 5 |
| C 9-8 | 48 | 25 | | | | | | | | 15 | | 5 | 7 |
| C 9-9 | 48 | 20 | | 2 | | | | | 15 | | 10 | | 5 |
| C 9-10 | 60 | 10 | 10 | | | | | 10 | | | | 5 | 5 |
| C 9-11 | 30 | 35 | 20 | | | | | | | 5 | | 3 | 7 |
| C 9-12 | 48 | 25 | | 2 | | | 15 | | | | 5 | | 5 |
| C 9-13 | 43 | 30 | | | | 10 | | | 10 | 5 | | | 3 |
| C 9-14 | 56 | 15 | | | 10 | | | | 10 | | | 2 | 7 |
| C 9-15 | 29 | 40 | | | | | 15 | | | 10 | | 1 | 5 |
| C 9-16 | 34 | 50 | | 1 | 10 | | | | | | | 2 | 3 |
| C 9-17 | 52 | 25 | | | | | | | 10 | 5 | | 1 | 7 |
| C 9-18 | 53 | 20 | | | | | 10 | 5 | | 7 | | 2 | 3 |
| C 9-19 | 33 | 30 | 15 | | | 5 | | 5 | | | 5 | | 7 |
| C 9-20 | 51 | 25 | 4 | 1 | | | | 10 | | 2 | | 2 | 5 |
| C 9-21 | 56 | 15 | 10 | | 5 | | | 5 | | 5 | | 1 | 3 |
| C 9-22 | 43 | 25 | 9 | 1 | | | 5 | | | | 5 | 7 | 5 |
| C 9-23 | 46 | 20 | 9 | 1 | | 5 | | 5 | | 5 | | 2 | 7 |

The alloys thus produced were subjected to an ASTM testing device under the same conditions as in Example 1 to evaluate the dielectric properties and wear properties thereof. The results were as shown in Table 9-4.

TABLE 9-4

| Alloy Symbol | Wear Amount (mg) | Range of Voltage Drop (mv) | Scattering of Voltage Drop (mv) |
|---|---|---|---|
| A 9-1 | 10 | 15~60 | 45 |
| A 9-2 | 15 | 12~65 | 53 |
| A 9-3 | 20 | 20~201 | 181 |
| A 9-4 | 13 | 16~70 | 54 |
| A 9-5 | 24 | 30~216 | 186 |
| A 9-6 | 21 | 16~70 | 54 |
| A 9-7 | 26 | 20~301 | 281 |
| A 9-8 | 30 | 31~206 | 175 |
| A 9-9 | 14 | 21~71 | 50 |
| A 9-10 | 28 | 35~198 | 163 |
| A 9-11 | 31 | 26~189 | 163 |
| A 9-12 | 12 | 17~98 | 81 |
| A 9-13 | 8 | 15~78 | 63 |
| A 9-14 | 29 | 28~150 | 122 |
| A 9-15 | 24 | 30~145 | 115 |
| A 9-16 | 28 | 25~201 | 176 |
| A 9-17 | 26 | 27~175 | 148 |
| A 9-18 | 21 | 24~180 | 156 |
| A 9-19 | 12 | 20~99 | 79 |
| A 9-20 | 24 | 33~105 | 72 |
| A 9-21 | 28 | 25~131 | 106 |
| A 9-22 | 31 | 31~145 | 114 |
| A 9-23 | 19 | 25~125 | 100 |
| B 9-1 | 12 | 17~63 | 46 |
| B 9-2 | 13 | 18~70 | 52 |
| B 9-3 | 17 | 14~71 | 57 |
| B 9-4 | 19 | 15~69 | 54 |
| B 9-5 | 23 | 22~220 | 198 |
| B 9-6 | 15 | 18~71 | 53 |
| B 9-7 | 26 | 20~299 | 279 |
| B 9-8 | 24 | 18~72 | 54 |
| B 9-9 | 28 | 23~310 | 287 |
| B 9-10 | 31 | 32~208 | 176 |
| B 9-11 | 17 | 25~70 | 45 |
| B 9-12 | 30 | 35~202 | 167 |
| B 9-13 | 32 | 27~180 | 153 |
| B 9-14 | 15 | 20~100 | 80 |
| B 9-15 | 9 | 17~70 | 53 |
| B 9-16 | 30 | 26~200 | 174 |
| B 9-17 | 26 | 29~150 | 121 |
| B 9-18 | 30 | 26~200 | 174 |
| B 9-19 | 25 | 21~180 | 159 |
| B 9-20 | 23 | 30~200 | 170 |
| B 9-21 | 14 | 27~100 | 73 |
| B 9-22 | 27 | 30~105 | 75 |
| B 9-23 | 31 | 26~135 | 109 |
| B 9-24 | 33 | 32~150 | 118 |
| B 9-25 | 24 | 27~130 | 103 |
| C 9-1 | 7 | 20~67 | 47 |
| C 9-2 | 14 | 10~63 | 53 |
| C 9-3 | 19 | 25~230 | 205 |
| C 9-4 | 15 | 14~55 | 41 |
| C 9-5 | 29 | 40~301 | 261 |
| C 9-6 | 17 | 18~80 | 62 |
| C 9-7 | 24 | 22~309 | 287 |
| C 9-8 | 35 | 28~180 | 152 |
| C 9-9 | 12 | 20~66 | 46 |
| C 9-10 | 26 | 32~180 | 148 |
| C 9-11 | 36 | 21~240 | 219 |
| C 9-12 | 14 | 20~101 | 81 |
| C 9-13 | 6 | 18~82 | 64 |
| C 9-14 | 34 | 40~100 | 60 |
| C 9-15 | 26 | 35~350 | 315 |
| C 9-16 | 24 | 30~401 | 371 |
| C 9-17 | 30 | 20~110 | 90 |
| C 9-18 | 17 | 29~190 | 161 |
| C 9-19 | 16 | 30~140 | 110 |
| C 9-20 | 22 | 30~99 | 69 |
| C 9-21 | 24 | 27~142 | 115 |
| C 9-22 | 32 | 40~208 | 168 |
| C 9-23 | 23 | 27~115 | 88 |

In relation to A9-1, B9-3, C9-3, A9-4, A9-5, A9-6, C9-7, C9-8, A9-4, A9-5, A9-6, C9-7, C9-8, C9-10, C9-11, A9-12, A9-13, A9-14, A9-15, C9-16, A9-17, A9-18, A9-19, A9-20, A9-21, A9-22, B9-25, the contact properties were evaluated under the same conditions as in Example 1 to obtain the results as shown in Table 9-5.

TABLE 9-5

| Alloy Symbol | Overload Test | Endurance Test | Temperature rise Test (°C.) | Short Circuit Test | Wear Amount (mg) | Insulation Resistance (MΩ) |
|---|---|---|---|---|---|---|
| A 9-1 | OK | OK | 18 | OK | 79 | ∞ |
| B 9-3 | " | " | 20 | " | 85 | " |
| C 9-3 | " | " | 102 | " | 102 | " |
| A 9-4 | " | " | 20 | " | 81 | " |
| A 9-5 | " | " | 99 | " | 150 | " |
| A 9-6 | " | " | 21 | " | 141 | " |
| C 9-7 | " | " | 150 | " | 175 | " |
| C 9-8 | " | " | 99 | " | 200 | " |
| A 9-9 | " | " | 21 | " | 95 | " |
| C 9-10 | " | " | 89 | " | 130 | " |
| C 9-11 | " | " | 106 | " | 290 | " |
| A 9-12 | " | " | 32 | " | 70 | " |
| A 9-13 | " | " | 16 | " | 60 | " |
| A 9-14 | " | " | 80 | " | 230 | " |
| A 9-15 | " | " | 81 | " | 200 | " |
| C 9-16 | " | " | 190 | " | 170 | " |
| A 9-17 | " | " | 103 | " | 210 | " |
| A 9-18 | " | " | 105 | " | 140 | " |
| A 9-19 | " | " | 89 | " | 81 | " |
| A 9-20 | " | " | 91 | " | 170 | " |
| A 9-21 | " | " | 111 | " | 150 | " |
| A 9-22 | " | " | 121 | " | 180 | " |
| B 9-25 | " | " | 101 | " | 145 | " |

Table 9-5 shows that the alloys according to the invention have contact properties of high performance, e.g., small wear amount, low temperature rise and high insulation resistance.

As described hereinabove, the alloys according to the invention not only have high contact properties but also contain a large amount of iron group metals, group IVa, Va, VIa metals, or carbides, nitrides, borides, and silicides thereof, thereby providing electric contact materials of high industrial value by drastically reducing the amount of costly silver.

We claim:

1. Electric contact material comprising 5–60 weight % of at least one iron group metal, 1–11 weight % of graphite, 5–70 weight % of refractory material, and the residual part consisting essentially of silver, said silver being present in the material in an amount of at least 10 weight %, wherein the refractory material is dispersed in the iron group metal and/or the silver.

2. Electric contact material as defined in claim 1, wherein the refractory material is at least one member selected from refractory metals of groups IVa, Va and VIa of the periodic table, and carbides, nitrides, borides and silicides thereof.

3. Electric contact material as defined in claim 1, wherein the refractory material comprises a refractory metal of group IVa, Va or VIa and a carbide thereof, the amount of said refractory metal being 0.1–5 weight %.

4. Electric contact material as defined in claim 1, wherein the refractory material comprises a boride and a silicide of a group IVa, Va or VIa refractory metal, the amount of said silicide being 0.1–30 weight %.

5. Electric contact material as defined in claim 1, wherein the refractory material comprises a group IVa, Va or VIa refractory metal and a nitride thereof, the amount of said refractory metal being 0.1–30 weight %.

6. Electric contact material as defined in claim 1, wherein the refractory material comprises 5–50 weight % of a nitride of a group IVa, Va, VIa, VIIa or VIIIa refractory metal.

7. Electric contact material as defined in claim 1, wherein the refractory material comprises a carbide of a group IVa, Va or VIa refractory metal and a nitride of a group IVa, Va, VIa, VIIa or VIIIa refractory metal, the amount of said nitride being 0.1–30 weight %.

8. A process for producing the electric contact material as defined in claim 1, which comprises mixing, all in powder form, 5–60 weight % of at least one iron group metal, 1–11 weight % of graphite, 5–70 weight % of refractory material, and silver; pressing the resultant mixture to obtain a compact; and sintering the compact at a temperature above 1000° C. in a reducing gas atmosphere for 1–5 hours.

* * * * *